US007977299B2

(12) United States Patent
Hoyt et al.

(10) Patent No.: US 7,977,299 B2
(45) Date of Patent: Jul. 12, 2011

(54) TREATED OXIDIZING AGENT, DETERGENT COMPOSITION CONTAINING A TREATED OXIDIZING AGENT, AND METHODS FOR PRODUCING

(75) Inventors: Jerry D. Hoyt, Hastings, MN (US); Brenda L. Tjelta, St. Paul, MN (US); Michael E. Besse, Golden Valley, MN (US); Kent Richard Brittain, Ellsworth, WI (US)

(73) Assignee: Ecolab USA Inc., St. Paul, MN (US)

( * ) Notice: Subject to any disclaimer, the term of this patent is extended or adjusted under 35 U.S.C. 154(b) by 1724 days.

(21) Appl. No.: 10/921,776

(22) Filed: Aug. 18, 2004

(65) Prior Publication Data

US 2006/0040846 A1 Feb. 23, 2006

(51) Int. Cl.
*C11D 1/00* (2006.01)
*C11D 3/39* (2006.01)
*C11D 3/395* (2006.01)

(52) U.S. Cl. ..... 510/309; 510/349; 510/375; 510/378; 510/379; 510/380; 510/381; 510/441; 510/505

(58) Field of Classification Search ..... 510/309, 510/349, 375, 378, 379, 380, 381, 441, 505
See application file for complete search history.

(56) References Cited

U.S. PATENT DOCUMENTS

| | | | | |
|---|---|---|---|---|
| 3,048,548 | A | 8/1962 | Martin et al. | |
| 3,334,147 | A | 8/1967 | Brunelle et al. | |
| 3,444,242 | A | 5/1969 | Rue et al. | |
| 3,650,961 | A | 3/1972 | Hudson | |
| 3,908,045 | A | 9/1975 | Alterman et al. | |
| 4,327,151 | A * | 4/1982 | Mazzola | 428/407 |
| 4,655,780 | A | 4/1987 | Chun et al. | |
| 4,657,784 | A | 4/1987 | Olson | |
| 4,681,914 | A | 7/1987 | Olson et al. | |
| 4,731,195 | A | 3/1988 | Olson | |
| 4,830,773 | A | 5/1989 | Olson | |
| 4,867,895 | A * | 9/1989 | Choy | 510/513 |
| 4,919,841 | A | 4/1990 | Kamel et al. | |
| 5,019,290 | A | 5/1991 | Bruegge et al. | |
| 5,200,236 | A | 4/1993 | Lang et al. | |
| 5,230,822 | A | 7/1993 | Kamel et al. | |
| 5,258,132 | A | 11/1993 | Kamel et al. | |
| 5,460,743 | A | 10/1995 | Delwel et al. | |
| 5,480,577 | A | 1/1996 | Nicholson et al. | |
| 5,498,378 | A | 3/1996 | Tsaur et al. | |
| 5,589,267 | A | 12/1996 | Delwel et al. | |
| 5,929,011 | A | 7/1999 | Scepanski | |
| 6,017,864 | A | 1/2000 | Brittain et al. | |
| 6,150,324 | A | 11/2000 | Lentsch et al. | |
| 6,156,715 | A | 12/2000 | Lentsch et al. | |
| 6,177,392 | B1 | 1/2001 | Lentsch et al. | |
| 6,218,351 | B1 * | 4/2001 | Busch et al. | 510/311 |
| 6,258,765 | B1 | 7/2001 | Wei et al. | |
| 6,475,969 | B2 | 11/2002 | Scepanski | |
| 6,632,785 | B2 | 10/2003 | Pfeiffer et al. | |
| 2003/0109403 | A1 | 6/2003 | Man et al. | |

FOREIGN PATENT DOCUMENTS

| | | | |
|---|---|---|---|
| GB | 2200377 | * | 8/1988 |
| WO | WO 2004/053040 A2 | | 6/2004 |

OTHER PUBLICATIONS

Grant & Hackh's Chemical Dictionary, 5th ed. p. 628-629 (1987).*
Kirk-Othmer, Encyclopedia of Chemical Technology, Third Edition, vol. 8, pp. 900-912.
Kirk-Othmer, Encyclopedia of Chemical Technology, Third Edition, vol. 5, pp. 339-366 and vol. 23, pp. 319-320.
ExxonMobil Chemical, "Material Safety Data Sheet—Norpar 12 Fluid," Date Prepared: Nov. 13, 2002, pp. 1-7.
ExxonMobil Chemical, "Material Safety Data Sheet—Isopar L Fluid," Date Prepared: Feb. 20, 2002, pp. 1-7.
ExxonMobil Chemical, "Norpar® 12 Fluid," Issue Date: Feb. 4, 2002, pp. 1-5.
ExxonMobil Chemical, "Isopar® L Fluid," Issue Date: Mar. 14, 2001, pp. 1-5.
Exxon Chemical, "Norpar® Solvents: For Cleaning and Degreasing Formulations," Date Unknown, 2 pages.
Exxon Chemical, "Isopar® Solvents: For Cleaning and Degreasing Formulations," Date Unknown, 4 pages.
Monsanto Industrial Chemicals Company, "Stoarage and Handling of ACL® Chlorinating Compositions," Vulletin No. IC/WT-104, Date Unknown, 29 pages.
ASTM International, "Standard Test Method for Needle Penetration of Petroleum Waxes," Date Unknown, pp. 507-509.
FMC Corporation, "The Chemistry and Applications of CDB Active Chlorine Compounds," Detergent Applications Bulletin No. 14, Date Unknown, pp. 1-27.
FMC Corporation, "Introduction to FMC Detergent Chemicals," Detergent Applications Bulletin, Date Unknown, pp. 1-33.
Kirk-Othmer, *Encyclopedia of Chemical Technology*, 4th Edition, vol. 25, pp. 618-621 (1998).
Mizuno, William G., "*Detergency. Theory and Test Methods, Part III.*" Marcel Dekker Press, pp. 848-861 (© 1972-[81]).

* cited by examiner

*Primary Examiner* — Gregory R Del Cotto
(74) *Attorney, Agent, or Firm* — Andrew D. Sorensen; Laura C. Dilorenzo

(57) ABSTRACT

A treated oxidizing agent is provided according to the invention. The treated oxidizing agent includes an oxidizing agent that is solid at room temperature and atmospheric pressure, and a chemical barrier composition provided on the oxidizing agent. The chemical barrier composition includes a hydrocarbon component having about 10 to about 85 carbon atoms, and wherein the chemical barrier composition is provided as a liquid at 25° C. A solid detergent composition is provided including the treated oxidizing agent. Methods for manufacturing are provided.

37 Claims, No Drawings

TREATED OXIDIZING AGENT, DETERGENT COMPOSITION CONTAINING A TREATED OXIDIZING AGENT, AND METHODS FOR PRODUCING

FIELD OF THE INVENTION

The invention relates to a treated oxidizing agent, a detergent composition containing a treated oxidizing agent, and methods for producing a treated oxidizing agent and a detergent composition. In particular, the treated oxidizing agent refers to an oxidizing agent that has been treated with a chemical barrier composition to impart chemical barrier properties to the oxidizing agent to reduce loss of activity of the oxidizing agent and/or loss of activity of the detergent composition in which the treated oxidizing agent is provided.

BACKGROUND OF THE INVENTION

It is often desirable to formulate a detergent composition that includes a bleaching agent. Many bleaching agents that provide bleaching and/or oxidizing properties are not compatible with many of the components found in a detergent composition. Because of this lack of compatibility, the detergent composition may lose bleaching activity and/or cleaning activity over time. For example, many bleaching agents have a tendency to react with components in a detergent composition including surfactants, alkaline components, and water. As a result, detergent compositions that include bleaching agents have a tendency to lose bleaching activity and cleaning activity over time unless steps are taken to physically separate the bleaching agent from the other components of the detergent composition.

Many techniques are available for coating and/or encapsulating bleaching agents so that the bleaching agents can be used in detergent compositions to provide use compositions having desired levels of bleaching and cleaning. Several techniques utilize a fluidized bed to encapsulate the bleaching agent. For example, see U.S. Pat. No. 4,657,784 to Olson, U.S. Pat. No. 4,830,773 to Olson, U.S. Pat. No. 4,731,195 to Olson, U.S. Pat. No. 4,681,914 to Olson et al., and International Publication No. WO 2004/053040 A2. Additional techniques that utilize a fluidized bed can be found in, for example, U.S. Pat. No. 3,650,961 to Hudson, U.S. Pat. No. 3,908,044 to Alterman, U.S. Pat. No. 3,908,045 to Alterman, U.S. Pat. No. 5,200,236 to Lange et al., and U.S. Pat. No. 5,230,822 to Kamel et al.

SUMMARY OF THE INVENTION

A treated oxidizing agent is provided according to the invention. The treated oxidizing agent includes an oxidizing agent that is solid at room temperature and atmospheric pressure, and a chemical barrier composition provided on the oxidizing agent. The chemical barrier composition includes a hydrocarbon component having about 10 to about 85 carbon atoms, and wherein the chemical barrier composition is provided as a liquid at 25° C.

A solid detergent composition is provided according to the invention. The solid detergent composition includes at least about 0.1 wt. % of the treated oxidizing agent, and at least about 0.1 wt. % of at least one of a surfactant and an alkalinity source.

A method for producing a treated oxidizing agent is provided according to the invention. The method includes a step of mixing an oxidizing agent and a chemical barrier composition. The step of mixing can include mixing at a weight ratio of the oxidizing agent and the chemical barrier composition of at least about 1:9.

A method for producing a detergent composition is provided according to the invention. The method includes a step of mixing the treated oxidizing agent and at least one of a surfactant and an alkalinity source. The treated oxidizing agent can be provided in an amount of at least about 0.1 wt. % based on the weight of the detergent composition, and the at least one of a surfactant and an alkalinity source can be provided at a concentration of at least about 0.1 wt. % of the detergent composition.

DETAILED DESCRIPTION OF THE INVENTION

A detergent composition can be provided that includes a treated oxidizing agent and a detersive agent. The treated oxidizing agent can be provided as a result of treating an oxidizing agent with a chemical barrier composition. The oxidizing agent can be referred to as a bleaching agent and is generally recognized as providing oxidizing properties and/or bleaching properties. Exemplary oxidizing agents include halogen bleaches and oxygen bleaches. The detersive agent generally refers to the component(s) of the detergent composition that provides for soil removal and often refers to components such as surfactants, builders, and alkalinity. In general, oxidizing agents and detersive agents are considered incompatible when they have a tendency to interact in a manner that reduces the activity of one and/or the other over time. This incompatibility is well known and numerous techniques have been developed to provide a physical coating around the oxidizing agent that physically separates the oxidizing agent and the detersive agent to reduce interaction. The Applicants discovered that the oxidizing agent can be treated with a chemical barrier composition that is available as a liquid at room temperature (about 25° C.) to reduce interaction between the oxidizing agent and the detersive agent.

The detergent composition can be characterized as a concentrate and/or as a use composition. When the detergent composition is provided as a concentrate, it can be available as a solid. Exemplary forms of the solid include blocks, pellets, tablets, powders, agglomerates, etc. The detergent composition can be transported and stored as a solid concentrate. The solid concentrate can be degraded in the presence of water to provide a liquid concentrate and/or a use composition. It is generally expected that a liquid concentrate will be diluted relatively soon after it is formed to form a use composition. The use composition is the composition that contacts articles and/or substrates intended to be cleaned and/or bleached. In general, the detergent composition is expected to be useful in applications where it is desirable to provide a detergent use composition having both bleaching properties and soil removal properties. Bleaching properties are often desired where there are protein soils that can be removed or cleaved, and where soils can be decolored. Exemplary articles that can be treated with the use composition include laundry, textiles, dishes, eating utensils, glasses, hard surfaces, floors, CIP (clean-in-place) systems, etc.

Exemplary components that can be found in the detergent composition, in addition to the treated oxidizing agent, include surfactants, diluents or fillers, and builders. Surfactants are generally provided for detergency. Diluents or fillers are often inorganic salts, acids, and bases, which do not contribute to detergency. Builders are provided to enhance detergency, foaming power, emulsifying power, or soil suspending effort. Additional components that may be present include alkalinity agents, brightening agents, bacteriacides, emollients, and aesthetic agents.

Treated Oxidizing Agent

The oxidizing agent that has been treated with a chemical barrier composition to provide chemical barrier properties can be referred to as the treated oxidizing agent. Chemical barrier properties refers to the existence of reduced interaction between the oxidizing agent and the other components of the detergent composition so that the resulting detergent use composition provides desired bleaching and detersive activity. It should be understood that the characterization of "reduced interaction provided by the chemical barrier composition" refers to a level of interaction that is lower, over a measured period of time and temperature as a solid concentrate, compared with the level of interaction that would occur without the presence of the chemical barrier composition. In general, it is expected that interaction between the oxidizing agent and the other components of the detergent composition will cause a reduction in the activity of the oxidizing agent and of the activity of the components of the detergent composition that interact with the oxidizing agent.

By providing a detergent composition exhibiting "reduced interaction provided by the chemical barrier composition," it is believed that the detergent composition will exhibit an activity reduction of the oxidizing agent that is less than an otherwise identical composition except not containing the chemical barrier composition. The "activity reduction" can be determined according to an aging test where the detergent composition is provided as a solid and aged for two weeks at 40° C. The activity of a use composition (a dilution of the solid detergent composition with water) can be determined before and after the aging test. The details of the activity reduction test are reported in Example 4. The activity reduction can be characterized by a percent. Accordingly, by providing an oxidizing agent containing a chemical barrier composition according to the invention, it is expected that the activity reduction will be less than would be observed without the chemical barrier composition present on the oxidizing agent. In general, it is expected that the activity reduction for a detergent composition containing a treated oxidizing agent according to the invention, and subjected to the aging test for two weeks at 40° C., will be less than about 40%. In addition, it is expected that the activity reduction can be less than about 30%, can be less than about 20%, and can preferably be about 0. By way of examples, it should be understood that a value of 0 reflects no loss in activity after the aging test, and an activity reduction of 20% reflects a reduction of activity of the oxidizing agent of 20% after the aging test. It is expected that an oxidizing agent that does not include the chemical barrier composition or any coating of the prior art will have an activity reduction of greater than 40% and probably closer to 75% after the aging test.

The oxidizing agent that can be treated can be referred to as a bleaching agent. The oxidizing agent that can be treated includes those oxidizing agents that are available as a solid at room temperature. Exemplary types of oxidizing agents or bleaching agents include halogen-containing bleaching agents and oxygen containing bleaching agents. Exemplary halogen-containing bleaching agents include those that are characterized as a chlorine source and/or as a bromine source. In general, a chlorine source refers to those components that produce elemental chlorine and/or chlorine compounds that are considered oxidizing agents when used in an aqueous, washing environment. Similarly, a bromine source refers to those components that produce elemental bromine and/or bromine compounds that are considered oxidizing agents when used in an aqueous, washing environment. Exemplary chlorine sources include potassium dichloroisocyanurate, sodium dichloroisocyanurate, chlorinated trisodium phosphate, calcium hypochlorite, lithium hypochlorite, [(monotrichloro)-tetra-(monopotassium dichloro)]-pentaisocyanurate, trichloromelamine, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethylhydantoin, 1-chloro-3-bromo-5-ethyl-5-methyl hydantoin, dichlorohydantoin, 1,3-dichloro-5-ethyl-5-methyl hydantoin, paratoluene sulfondichloro-amide, N-chlorammeline, N-chlorosuccinimide, N,N'-dichloroazodicarbonamide, monotrichloro-tetra(monopotassium dichloro-s-triazine trione), trichloro-s-triazine trione salts or hydrates thereof, and mixtures thereof. A preferred chlorine source is sodium dichloroisocyanurate dihydrate, which is commercially available from the Olin Corporation under the trade name CLEARON CDB-56. Exemplary bromine containing oxidizing agents includes 1-bromo-3-chloro-5,5-dimethylhydantoin, and 1,3-dibromo-5,5-dimethylhydantoin. Oxygen containing oxidizing agents refer to those components that produce a bleaching effect when provided in an aqueous, washing environment. It is believed that the bleaching effect is attributable to the presence of active oxygen. Exemplary oxygen containing oxidizing agents include sodium permanganate, sodium percarbonate, sodium perborate, sodium persulfate, and urea hydrogen peroxide.

The oxidizing agent can be treated with a chemical barrier composition to provide the oxidizing agent with chemical barrier properties that reduce the tendency of the oxidizing agent to interact with components of the detergent composition. The chemical barrier composition can be provided as a composition that remains as a liquid at room temperature. Room temperature is characterized as about 25° C. Preferably, the chemical barrier composition remains a liquid at 10° C. It should be understood that the characterization of the chemical barrier composition as a liquid includes states where the composition can be characterized as a soft paste and/or as a flowable paste. The characterization of the chemical barrier composition as a liquid at room temperature (about 25° C.) means that the chemical barrier composition does not provide a rigid coating on the oxidizing agent at room temperature. The absence of a rigid coating can be characterized by the inability to obtain a value of needle penetration according to ASTM D 1321-97 for the chemical barrier composition. If the chemical barrier composition registers a needle penetration value at 25° C. according to ASTM D 1321-97, then the composition is not a liquid at 25° C. If the composition is a liquid, it is expected that the needle, under a load of 100 g for five seconds, would pass through the composition resulting in no measurable value. It should be understood that a paste would be considered a liquid if the paste fails to register a needle penetration value at 25° C. according to ASTM D 1321-97.

The chemical barrier composition can be selected so that it is inert to the oxidizing agent. That is, the chemical barrier composition can be provided so that it does not interact with the oxidizing agent resulting in decreased activity of the oxidizing agent. For example, it is believed that certain components such as those containing unsaturation (such as a double bond) may interact with the oxidizing agent. The chemical barrier composition can be provided as free of or substantially free of those components that may interact with the oxidizing agent. Accordingly, the chemical barrier composition can be provided so that it has less than about 0.1 wt. % of components having unsaturation, and preferably has 0 wt. % component having unsaturation. It should be understood that unsaturation refers to the presence of double bonds, triple bonds, or aromatic groups. In addition, it is understood that many commercially available hydrocarbons contain unsaturation such as double bonds. In addition, it is understood that many commercially available hydrocarbons include components therein that contain unsaturation such as double bonds. Such components in commercially available hydrocarbons may be present as stabilizers, antioxidants, etc. The hydrocarbons that can be used according to the invention include those having less than about 0.1 wt. % and preferably 0 wt. % of components that can be characterized as stabilizers and antioxidants. Stabilizers and antioxidants are components that may contain aromatic groups, alkene groups, and/or alkyne groups.

The chemical barrier composition can include a hydrocarbon component that can be characterized as a saturated hydrocarbon having about 10 to about 85 carbon atoms. The saturated hydrocarbon can be characterized by the general formula $C_nH_{2n+2}$ wherein n is about 10 to about 85 and can include linear and/or branched chains.

The hydrocarbon component can be provided from several sources and can include mixtures of various hydrocarbon sources. Exemplary hydrocarbon sources include paraffins such as normal paraffins and isoparaffins, mineral oils, and petrolatums. Exemplary paraffins include those having about 10 to about 14 carbon atoms, and exemplary mineral oils or petrolatums include those having about 12 to about 85 carbon atoms. Exemplary normal paraffins that can be used include those available under the name Norpar from ExxonMobile Chemical. Exemplary isoparaffins that can be used include those available under the name Isopar from ExxonMobile Chemical. It is believed that the Norpar series can be characterized as having a chain length of $C_{10}$-$C_{14}$ and characterized as having a dominance of $C_{11}$ (43%) and $C_{12}$ (39%) molecules. It is believed that the Isopar series can be characterized as synthetic isoparaffinic having a chain length of about $C_{10}$-$C_{14}$ and can be characterized by having a dominance of $C_{11}$ (60%) and $C_{12}$ (32%) molecules.

The chemical barrier composition can be characterized as having a relatively low evaporation rate so that it does not dry to form a rigid coating on the oxidizing agent. As discussed above, the chemical barrier composition can be characterized as a liquid because of the absence of a measurable needle penetration value according to ASTM D 1321-97. During manufacture of the treated oxidizing agent and the use of the treated oxidizing agent in the formation of a solid detergent composition, it is expected that the chemical barrier composition will remain as a liquid. Expressed differently, it is expected that the chemical barrier composition will not dry to form a rigid coating on the oxidizing agent. The evaporation rate of the chemical barrier composition can be compared with normal butyl acetate. The chemical barrier composition can be characterized as having an evaporation rate that is less than 50% of the evaporation rate of n-butyl acetate. In addition, the chemical barrier composition can be characterized as having an evaporation rate that is less than about 10% of the evaporation rate of n-butyl acetate, and more preferably less than about 5% of the evaporation rate of n-butyl acetate. Evaporation rates can be determined according to ASTM D-3539. Under this comparison, n-butyl acetate can be characterized as having an evaporation rate of 100, Norpar 12 can be characterized as having an evaporation rate of 3, Norpar 13 can be characterized as having an evaporation rate of 0.1, Norpar 15 can be characterized as having an evaporation rate of less than 0.1, Isopar G can be characterized as having an evaporation rate of about 27, Isopar H can be characterized as having an evaporation rate of about 9, Isopar K can be characterized as having an evaporation rate of about 8, Isopar L can be characterized as having an evaporation rate of about 4, Isopar M can be characterized as having an evaporation rate of about 0.5, and Isopar V can be characterized as having an evaporation rate of about 0.1.

The chemical barrier composition can include a durability additive to enhance the chemical barrier properties of the chemical barrier composition. In general, the durability additives can be provided as solid at room temperature (about 25° C.) but, when provided in the chemical barrier composition, results in a chemical barrier composition that remains a liquid or a soft paste at room temperature. Exemplary durability additives include paraffin wax, microcrystalline wax, clays, and mixtures thereof. An exemplary paraffin wax is available having a carbon number range of about $C_{18}$ to about $C_{60}$, a melting point of 46° C. to 68° C., and a preferred melting point of about 46° C. to about 60° C. An exemplary microcrystalline wax is available having a carbon number in the range of about $C_{23}$ to about $C_{85}$, a melting point range of about 46° C. to about 93° C., and a preferred melting point of about 46° C. to about 60° C. Exemplary clays include montmorillonite available under the name Mineral Colloid MO from Southern Clay Products, Smectite available under the name Veegum HS from Vanderbilt, bentonite available under the name Veegum F from Vanderbilt, synthetic clay available under the name Laponite RDS from Southern Clay Products, and synthetic clay available under the name Laponite RD from Southern Clay Products.

The chemical barrier composition can be provided without the durability additive. When the durability additive is included in the chemical barrier composition, it can be provided in the amount that provides enhanced durability properties as exhibited by an increase in the bleaching activity and/or cleaning activity of a detergent composition containing the treated oxidizing agent. Expressed differently, the chemical barrier composition can include a durability additive to decrease the "activity reduction" value compared with a treated oxidizing agent not containing the durability additive. The "activity reduction" can be determined according to the tests described in the Examples.

The chemical barrier composition can include a sufficient amount of the hydrocarbon component to provide for ease of application to the oxidizing agent. In general, it is expected that the amount of hydrocarbon component in the chemical barrier composition can be at least about 40 wt. % to provide a desired ease of coverage of the oxidizing agent, and can be up to 100 wt. % when the chemical barrier composition includes no durability additive. When the chemical barrier composition includes a durability additive, it is expected that the chemical barrier composition will include up to about 98 wt. % of the hydrocarbon component. In applications where the chemical barrier composition includes a durability additive, it is expected that the chemical barrier composition can include between about 50 wt. % and about 90 wt. % of the hydrocarbon component. In addition, it is expected that the chemical barrier composition can include between about 60 wt. % and about 80 wt. % of the hydrocarbon component. In general, the durability additive can be included in the chemical barrier composition in an amount to provide a desired level of durability that can be reflected in a treated oxidizing agent exhibiting an "activity reduction" that is lower than what would be achieved without the durability additive. In general, it is expected that paraffin wax, microcrystalline wax, and clay can be used as durability additives. Paraffin wax can be included in the chemical barrier composition in a range of about 2 wt. % to about 60 wt. %, and about 5 wt. % to about 50 wt. %. Microcrystalline wax is included in the chemical barrier composition in an amount of about 0.1 wt. % to about 60 wt. %, and about 0.5 wt. % and about 10 wt. %. The clay is an optional component. When it is included, it can be included in the chemical barrier composition in an amount of about 0.1 wt. % about 60 wt. %, and in an amount of about 10 wt. % and about 50 wt. %. The durability additives can be incorporated into the chemical barrier composition as mixtures. A mixture of the paraffin wax and the microcrystalline wax can be provided in the chemical barrier composition. In the case of a mixture of paraffin wax and microcrystalline wax, the weight ratio of the paraffin wax to the microcrystalline wax can be about 1:1 to about 20:1. It should be understood that the durability additives do not have to be used in mixtures and that they can be used individually as durability additives.

The chemical barrier composition can be applied to the oxidizing agent by mixing. That is, the oxidizing agent and the chemical barrier composition can be mixed together to provide contact between the oxidizing agent and the chemical barrier composition. An advantage of the invention is the ability to avoid using expensive and complicated equipment such as fluidized bed or other equipment requiring heating of the composition. The oxidizing agent and the chemical barrier composition can be mixed together without the addition of heat to form the treated oxidizing agent. Although the step of mixing the chemical barrier composition and the oxidizing agent can be provided without the addition of heat, it should the understood that the mixture can be heated or cooled as desired. Furthermore, it should be understood that the formation of the chemical barrier composition may involve the use of heat. For example, it may be desirable to melt the paraffin wax and/or the microcrystalline wax to allow it to solubilize with the hydrocarbon component. The resulting mixture can be used as is or it can be cooled to room temperature and used to form the treated oxidizing agent. It is expected that the selection of temperature for mixing the chemical barrier composition and the oxidizing agent will at least in part reflect the properties of the oxidizing agent. For example, it may be desirable to avoid melting the oxidizing agent. Similarly, it may be desirable to avoid dehydrating and/or decomposing the oxidizing agent.

The weight ratio of the oxidizing agent to the chemical barrier composition should be sufficient to provide desired coverage of the surface of the oxidizing agent with the chemical barrier composition to preserve a desired level of activity. It is understood that the surface area of the oxidizing agent will vary depending upon the particular oxidizing agent and its particle size. As a result, the ratio of the oxidizing agent to the chemical barrier composition can vary. For example, in the case of the oxidizing agent being characterized as nanoparticles, it is expected that the weight ratio of the chemical barrier composition to the oxidizing agent to provide the desired level of coverage would be higher than the weight ratio needed to get the desired level of coverage from much larger particle sized oxidizing agents. In general, the desire is to provide a sufficient amount of chemical barrier composition to obtain the desired level of coverage and to avoid using too much of chemical barrier composition to avoid waste. In the case of the oxidizing agent having an average particle size greater than about 150 microns, it is expected that the weight ratio of the chemical barrier composition to the oxidizing agent will be at least about 1:9, and can be up to about 1:1. In general, it is expected that the weight ratio of the chemical barrier composition to the oxidizing agent will be between about 1:5 and about 1:2. The weight percentage of the chemical barrier composition in the treated oxidizing agent can be provided to obtain the desired level of coverage and should not be so great as to cause waste of the chemical barrier composition. In general, it is expected that the treated oxidizing agent will include at least about 10 wt. % of the chemical barrier composition and will include less than about 50 wt. % of the chemical barrier composition. The treated oxidizing agent can include between about 15 wt. % and about 45 wt. % of the chemical barrier composition, and can include between about 20 wt. % and about 40 wt. % of the chemical barrier composition. The treated oxidizing agent can include at least about 50 wt. % oxidizing agent and can include less than about 90 wt. % oxidizing agent. In addition, the treated oxidizing agent can include between about 55 wt. % and about 85 wt. % of the oxidizing agent, and can include between about 60 wt. % and about 80 wt. % of the oxidizing agent. In the case where the average particle size of the oxidizing agent is less than about 150 microns, it is expected that it may be desirable to provide a weight ratio of the chemical barrier composition to the oxidizing agent that is between about 1:1 and about 1:99.

Detergent Composition

The solid detergent composition can be provided in the form of an aggregate, powder, granule, pellets, tablets, flake, and blocks. In addition, the solid detergent composition can be ground or formed into powder, granule, flakes, etc. The solid detergent composition can be formed by extrusion, casting, molding, etc.

The treated oxidizing agent can be incorporated into the detergent composition in an amount sufficient to provide the use composition with a desired level of bleaching activity. It is expected that the detergent concentrate will include at least about 0.1 wt. % of the treated oxidizing agent based on the weight of the concentrated detergent composition. The maximum amount of the treated oxidizing agent in the detergent concentrate can be selected so that there is sufficient room for the remaining components of the detergent composition to provide desired cleaning properties in a particular cleaning application. It is generally expected that the amount of the treated oxidizing agent will be less than about 30 wt. % based on the weight of the detergent composition concentrate. In addition, the detergent concentrate can include about 1 wt. % to about 10 wt. % of the treated oxidizing agent.

The detergent composition according to the invention may further include additional functional materials or additives that provide a beneficial property, for example, to the composition in solid form or when dispersed or dissolved in an aqueous solution, e.g., for a particular use. Examples of additives include one or more of each of salts, chelating/sequestering agent, alkalinity source, surfactant, detersive polymer, rinse aid composition, softener, pH modifier, anti-corrosion agent, secondary hardening agent, solubility modifier, detergent builder, detergent filler, defoamer, anti-redeposition agent, a threshold agent or system, aesthetic enhancing agent (i.e., dye, odorant, perfume), optical brighteners, lubricant compositions, enzyme, effervescent agent, activator for the active oxygen compound, other such additives or functional ingredients, and the like, and mixtures thereof. Adjuvants and other additive ingredients will vary according to the type of composition being manufactured, and the intended end use of the composition. Preferably, the composition includes as an additive one or more of source of alkalinity, surfactant, detergent builder, detersive polymer, threshold agent, and anti-redeposition agent, and mixtures thereof. It should be appreciated that each of the identified components can be present in the detergent composition or, if desired, can be omitted from the detergent composition. That is, it is contemplated that each of the listed additional functional materials or additives can be explicitly omitted from the detergent composition.

Alkalinity Sources

The alkalinity source can be provided so that the detergent use composition exhibits a level of alkalinity that provides desired soil removal properties. Exemplary alkalinity sources include alkaline metal salts such as alkali metal carbonates, silicates, phosphonates, sulfates, borates, or the like, and mixtures thereof. Alkali metal carbonates can be preferred in certain applications, and some examples of preferred carbonate salts include alkali metal carbonates such as sodium or potassium carbonate, bicarbonate, sesquicarbonate, mixtures thereof, and the like; preferably sodium carbonate, potassium carbonate, or mixtures thereof.

In some embodiments the alkali metal salts can provide for the formation of an additional binder complex or binding agent including: alkali metal salt; organic sequestrant including a phosphonate, an aminocarboxylic acid, or mixtures thereof; and water. Such binder complexes can be referred to as "E-Form" hydrates. Such E-Form hydrates are discussed in detail in the following U.S. patents and patent applications: U.S. Pat. Nos. 6,177,392 B1; 6,150,324; and 6,156,715; and U.S. patent application Ser. No. 08/989,824; each of which is incorporated herein by reference.

Additional alkalinity sources can include, for example, inorganic alkalinity sources, such as an alkali metal hydroxide or silicate, or the like. Suitable alkali metal hydroxides include, for example, sodium or potassium hydroxide.

The detergent composition concentrate can include the alkalinity source in the range of 0.1 wt. % to about 80 wt. %, about 15 to about 70 wt. %, and about 20 to about 60 wt. %. In addition, the detergent composition concentrate can, if desired, contain no alkalinity source.

Chelating/Sequestering Agents

Chelating/sequestering agents that can be used include organic phosphonates, aminocarboxylic acids, and mixtures thereof. Exemplary organic phosphonates include those that are suitable for use in forming the solidified composition with the active oxygen compound and water. Organic phosphonates include organic-phosphonic acids, and alkali metal salts thereof. Some examples of suitable organic phosphonates include: 1-hydroxyethane-1,1-diphosphonic acid: $CH_3C(OH)[PO(OH)_2]_2$ (HEDP); aminotri(methylenephosphonic acid): $N[CH_2PO(OH)_2]_3$ (ATMP); aminotri(methylenephosphonate), sodium salt

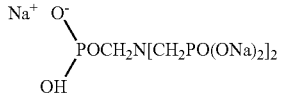

2-hydroxyethyliminobis(methylenephosphonic acid): $HOCH_2CH_2N[CH_2PO(OH)_2]_2$;
diethylenetriaminepenta(methylenephosphonic acid): $(HO)_2POCH_2N[CH_2CH_2N[CH_2PO(OH)_2]_2]_2$;
diethylenetriaminepenta(methylenephosphonate), sodium salt: $C_9H_{(28-x)}N_3Na_xO_{15}P_5$ (x=7); hexamethylenediamine (tetramethylenephosphonate), potassium salt: $C_{10}H_{(28-x)}N_2K_xO_{12}P_4$ (x=6);
bis(hexamethylene)triamine(pentamethylenephosphonic acid): $(HO_2)POCH_2N[(CH_2)_6N[CH_2PO(OH)_2]_2]_2$; and phosphorus acid $H_3PO_3$; and other similar organic phosphonates, and mixtures thereof.

An exemplary organic phosphonate is HEDP (1-hydroxyethane-1,1-diphosphonic acid). A neutralized or alkaline phosphonate, or a combination of the phosphonate with an alkali source prior to being added into the mixture such that there is little or no heat or gas generated by a neutralization reaction when the phosphonate is added is preferred.

The organic sequestrant can also include aminocarboxylic acid type sequestrant. Aminocarboxylic acid type sequestrant can include the acids, or alkali metal salts thereof. Some examples of aminocarboxylic acid materials include amino acetates and salts thereof. Some examples include the following:

N-hydroxyethylaminodiacetic acid;
hydroxyethylenediaminetetraacetic acid, nitrilotriacetic acid (NTA);
ethylenediaminetetraacetic acid (EDTA);
N-hydroxyethyl-ethylenediaminetriacetic acid (HEDTA);
diethylenetriaminepentaacetic acid (DTPA); and
alanine-N,N-diacetic acid;
and the like; and mixtures thereof.

Other chelating/sequestering agents, in addition to the phosphonate or aminocarboxylic acid sequestrant discussed above, can be added to the composition and are useful for their sequestering properties. In general, a chelating/sequestering agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount.

Examples of chelating/sequestering agents include aminocarboxylic acids, condensed phosphates, polymeric polycarboxylates, and the like. Examples of condensed phosphates include sodium and potassium orthophosphate, sodium and potassium pyrophosphate, sodium and potassium tripolyphosphate, sodium hexametaphosphate, and the like. Polycarboxylates suitable for use as cleaning agents include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamidemethacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339-366 and volume 23, pages 319-320, the disclosure of which is incorporated by reference herein.

The detergent composition concentrate can include a chelating/sequestering agent in an amount of between about 0.1 wt. % and about 70 wt. %, and between about 5 wt. % and about 60 wt. %. In addition, the detergent composition concentrate can include 0 wt. % chelating/sequestering agent.

Organic Surfactants or Cleaning Agents

The composition can include at least one cleaning agent which is preferably a surfactant or surfactant system. A variety of surfactants can be used in a cleaning composition, including anionic, nonionic, cationic, and zwitterionic surfactants, which are commercially available from a number of sources. Nonionic agents are preferred. For a discussion of surfactants, see Kirk-Othmer, *Encyclopedia of Chemical Technology*, Third Edition, volume 8, pages 900-912.

Anionic surfactants useful in the present cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are diphenyl sulfonate derivatives.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC (BASF-Wyandotte), and the like; ethoxylated amines and other like nonionic compounds. Silicone surfactants such as the ABIL B8852 (Goldschmidt) can also be used.

Cationic surfactants useful for inclusion in a cleaning composition for fabric softening or for reducing the population of one or more microbes include amines such as primary, secondary and tertiary monoamines with $C_{6-24}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl ($C_6$-$C_{24}$)dimethylbenzyl ammonium chloride, n-tetradecyldimethylbenzylammonium chloride monohydrate, a naphthalene-substituted quaternary ammonium chloride such as dimethyl-1-naphthylmethylammonium chloride, and the like; and other like cationic surfactants.

The detergent composition concentrate can include a surfactant in an amount of between about 0.1 wt. % and about 20 wt. %, and between about 0.1 wt. % and about 5 wt. %. In addition, the detergent composition concentrate can include 0 wt. % surfactant.

Activators

In some embodiments, the bleaching activity of the composition can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. It should be understood that the detergent composition concentrate can exclude the activator when, for example, there is no oxidizing agent containing an active oxygen. In addition, one would understand that the amount of activator incorporated into the detergent composition would be sufficient to provide desired activation properties when the oxidizing agent includes an active oxygen containing oxidizing agent.

Rinse Aid Functional Materials

Functional materials of the invention can include a formulated rinse aid composition containing a wetting or sheeting agent combined with other optional ingredients in a solid made using the complex of the invention. The rinse aid component of the present invention can include a water soluble or dispersible low foaming organic material capable of reducing the surface tension of the rinse water to promote sheeting action and to prevent spotting or streaking caused by beaded water after rinsing is completed. This is often used in warewashing processes. Such sheeting agents are typically organic surfactant-like materials having a characteristic cloud point. The cloud point of the surfactant rinse or sheeting agent is defined as the temperature at which a 1 wt-% aqueous solution of the surfactant turns cloudy when warmed.

In an embodiment, compositions according to the present invention provide desirable rinsing properties in ware washing without employing a separate rinse agent in the rinse cycle. For example, good rinsing occurs using such compositions in the wash cycle when rinsing employs just soft water. The detergent composition can contain 0 wt. % rinse aid, and the detergent composition can contain an amount of the rinse aid component that provides desired rinse aid properties.

Defoaming Agents

Examples of defoaming agents suitable for use in the present compositions include silicone compounds such as silica dispersed in polydimethylsiloxane, EO/PO block copolymers, alcohol alkoxylates, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

The detergent composition concentrate can include a defoaming agent in an amount of between about 0.1 wt. % to about 5 wt. %, and about 0.25 wt. % to about 3 wt. %. It should be understood that the detergent composition concentrate can include 0 wt. % defoaming agent.

Anti-Redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like.

The detergent composition concentrate can include an anti-redeposition agent in an amount of about 0.5 wt. % to about 10 wt. %, and about 1 wt. % to about 5 wt. %. In addition, the detergent composition concentrate can include 0 wt. % anti-redeposition agent.

Optical Brighteners

Optical brightener is also referred to as fluorescent whitening agents or fluorescent brightening agents provide optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners absorb light in the ultraviolet range 275 through 400 nm. and emit light in the ultraviolet blue spectrum 400-500 nm. It should be understood that the optical brightener component is optional. When it is included in the detergent composition concentrate, it can be included in an amount that imparts desired optical brightening properties. In addition, it can be excluded from the detergent composition.

Water

Water, or a source of water, preferably purified or distilled water, is used as a component of the solid compositions. However, as discussed briefly above, in some embodiments, water is optional.

The detergent composition, when provided as a concentrate, can include water in an amount of about 0.5 wt. % to about 40 wt. %, and about 20 wt. % to about 25 wt. %. It is generally expected that the detergent composition concentrate will include at least some amount of water as a result of water transferring from the humidity in the air.

Dyes/Odorants

Various dyes, odorants including perfumes and fragrances, and other aesthetic enhancing agents may also be included in the composition.

Table 1 provides a general range of exemplary components for the detergent composition when provided as a solid concentrate.

TABLE 1

| Component | Wt. % | Wt. % |
|---|---|---|
| Treated oxidizing agent | 0.1-30 | 1.0-10.0 |
| Alkalinity source | 1.0-80 | 15-70 |
| Chelating/sequestering agent | 0.1-70 | 5-60 |
| Surfactant | 0.1-20 | 0.5-5 |
| Defoaming agent | 0.1-5 | 0.25-3 |
| Anti-redeposition agent | 0.5-10 | 1-5 |
| Water | 0.5-40 | 2.0-25 |

Processing of the Composition

The components of the detergent composition can be mixed together and can be allowed to form a substantially homogeneous liquid or semi-solid mixture in which the ingredients are distributed throughout its mass. The mixing system can be a batch process or continuous flow mixer and can also be a single or twin screw extruder apparatus. The technique of mixing or combining can be selected to provide the composition in a desired form of block (extruded or cast), pellet, tablet, powder, agglomerate, etc. Those of skill in the art will recognize other suitable mixing systems.

The mixture can be processed at a temperature to maintain the physical and chemical stability of the ingredients. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant, or other additive, a secondary hardening agent, and the like. One or more premixes may be added to the mixture.

The ingredients can be mixed to form a consistency wherein the ingredients are distributed substantially evenly throughout the mass. In some embodiments, the mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. The composition can be allowed to harden to a solid form that may range from a low density, sponge-like, malleable, caulky consistency to a high density, fused solid, concrete-like block.

It will be understood by those of skill in the art and others that while certain processing techniques, for example, extrusion techniques may be preferred in certain embodiments, other processing techniques are contemplated for use in other embodiments. For example, a broad variety of mixing, forming, casting, molding, extruding, and other such techniques may be used to form the solid composition in accordance with other embodiments of the invention.

Solid compositions embodying the invention can be used in a broad variety of cleaning and destaining applications. Some examples include machine and manual warewashing, presoaks, laundry and textile cleaning and destaining, carpet cleaning and destaining, surface cleaning and destaining, kitchen and bath cleaning and destaining, floor cleaning and destaining, cleaning in place operations, general purpose cleaning and destaining, and the like.

Example 1

Preparation of Treated Oxidizing Agent

A 7 lb. batch of treated oxidizing agent was prepared from the following components:

- 4.68 lb. sodium dichloroisocyanurate having 56% available chlorine (available from Clearon)
- 1.92 lb. hydrocarbon (Norpar 13 available from ExxonMobile Chemical)
- 0.19 lb. paraffin wax (R-2536 available from Sasol Wax Company)
- 0.02 lb. microcrystalline wax (HP3040 available from Hase Petroleum Wax Company)

The hydrocarbon was added to a steam jacketed mixing vessel. The hydrocarbon was agitated and heated in the steam jacketed mixing vessel to a temperature of 60° C., and the paraffin wax and the microcrystalline wax were added with mixing to obtain a clear single-phase liquid that can be referred to as the chemical barrier composition. The chemical barrier composition was allowed to cool to room temperature and then mixed with the oxidizing agent in a separate vessel. The chemical barrier composition and the oxidizing agent were allowed to contact for two hours. The resulting composition can be referred to as the treated oxidizing agent.

Example 2

Chlorine Stability Test

Chlorine stability results for detergent blocks stored at 50° C. for four weeks are detailed in Table 2. The detergent block characterized as "rigid coating" is a detergent composition as reported in Table 3. The product includes an oxidizing agent having a rigid coating that was prepared utilizing a fluidized bed. The rigid coating can be prepared according to U.S. Pat. No. 4,830,773. The other detergent block characterized as "treated oxidizer" contained an identical composition except that the oxidizing agent having a rigid coating was replaced with the treated oxidizing agent from Example 1. Both detergent blocks contained an equal amount of active chlorine initially. The oxidizer in both blocks was sodium dichloroisocyanurate having 56% available chlorine.

In this example, the amount of chlorine was determined in a 1000 ppm solution of detergent as dispensed into a commercial dish machine. The chlorine level was determined by a standard Iodine-Chlorine test kit where phosphoric acid and potassium iodide were added to the detergent solution, and the resulting solution was titrated with sodium thiosulfate to a starch indicator endpoint.

TABLE 2

Stability Results

| Detergent Block | Initial chlorine level, ppm in wash tank | Final chlorine level, ppm in wash tank |
|---|---|---|
| Rigid coating | 22 | 21 |
| Treated Oxidizer | 22 | 22 |

TABLE 3

Detergent Composition

| Component | Percent |
|---|---|
| Soft Water | 7.8 |
| Dense ash, $Na_2CO_3$ | 52.66 |
| Tripolyphosphate, large granular | 22.54 |
| Surfactant | 2.72 |
| HEDP (N-hydroxyethyl-ethylenediaminetriacetic acid) | 5.77 |
| Oxidizing agent | 8.5 |

The results reported in Table 2 show that the level of chlorine stability in the solid detergent blocks containing the oxidizing agent having the rigid coating and the treated oxidizing agent is very close after four weeks at elevated temperature storage conditions.

Example 3

Chlorine Stability Test

A treated oxidizing agent was prepared by combining 100 g of disodium dichloroisocyanurate having 56% available chlorine and 35 g liquid hydrocarbon (available under the name Norpar from ExxonMobile Chemical) in a glass container for 24 hours. The excess hydrocarbon was decanted after this time. In this example, 23 g of hydrocarbon were recovered. The treated oxidizing agent can be characterized as containing 50% available chlorine.

The treated oxidizing agent was placed in a solid detergent composition block having the amounts of components identified in Table 3 wherein the "oxidizing agent" is the "treated oxidizing agent." A comparative block was prepared based upon the composition identified in Table 3 wherein the oxidizing agent was the oxidizing agent containing a rigid coating as described in Example 2. Six blocks were stored at 25° C., 40° C., or 50° C. for two weeks.

Powdered samples from each block were dissolved in water and the level of chlorine was determined using a standard iodine-chlorine test kit. Table 4 shows that the chlorine stability of the rigid coating requiring a fluidized bed and the treated oxidizing agent yield comparable results.

TABLE 4

Stability Results

| Chlorine Source | Storage Temp. | % available chlorine after 14 days at storage temperature compared to initial |
|---|---|---|
| Rigid coating | 25° C. | 95 |
| Rigid coating | 40° C. | 69 |
| Rigid coating | 50° C. | 81 |
| Treated oxidizer | 25° C. | 93 |
| Treated oxidizer | 40° C. | 99 |
| Treated oxidizer | 50° C. | 70 |

Example 4

Activity Reduction Test

An activity reduction test can be prepared according to the following procedure. Based upon the composition identified in Table 3, wherein the oxidizing agent is a treated oxidizing agent according to Example 1, the composition can be aged at 40° C. for two weeks. It is expected that the reduction in activity as determined by the level of chlorine using a standard iodine-chlorine test kit will be less than about 40%, and can be less than about 30%, and can be less than about 20%. It should be understood that the detergent composition is diluted to a concentration useful for the titration, and that the before and after aging titrations are done at identical concentrations.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A treated oxidizing agent comprising:

(a) an oxidizing agent that is solid at room temperature and atmospheric pressure;

(b) a chemical barrier composition provided on the oxidizing agent, the chemical barrier composition comprising a hydrocarbon component having about 10 to about 85 carbon atoms, and wherein the chemical barrier composition is provided as a liquid at 25° C., and does not register a needle penetration value according to ASTM D 1321-97.

2. A treated oxidizing agent according to claim 1, wherein the hydrocarbon component comprises a normal paraffin hydrocarbon.

3. A treated oxidizing agent according to claim 1, wherein the hydrocarbon component comprises an isoparaffin hydrocarbon.

4. A treated oxidizing agent according to claim 1, wherein the hydrocarbon component comprises mineral oil.

5. A treated oxidizing agent according to claim 1, wherein the hydrocarbon component comprises petrolatum.

6. A treated oxidizing agent according to claim 1, wherein the treated oxidizing agent comprises a result of mixing about 50 wt. % to about 90 wt. % of the oxidizing agent and about 10 wt. % and about 50 wt. % of the chemical barrier composition.

7. A treated oxidizing agent according to claim 1, wherein the chemical barrier composition has an evaporation rate of less than 50% of n-butyl acetate.

8. A treated oxidizing agent according to claim 1, wherein the chemical barrier composition further comprises a durability additive comprising at least one of paraffin wax, microcrystalline wax, and clay.

9. A treated oxidizing agent according to claim 1, wherein the chemical barrier composition comprises about 2 wt. % to about 60 wt. % paraffin wax.

10. A treated oxidizing agent according to claim 1, wherein the chemical barrier composition comprises about 0.1 wt. % to about 60 wt. % microcrystalline wax.

11. A treated oxidizing agent according to claim 1, wherein the chemical barrier composition comprises mixture of paraffin wax and microcrystalline wax at a weight ratio of the paraffin wax to the microcrystalline wax of about 1:1 to about 20:1.

12. A treated oxidizing agent according to claim 1, wherein the chemical barrier composition comprises about 0.1 wt. % to about 60 wt. % clay.

13. A treated oxidizing agent according to claim 1, wherein the weight ratio of the chemical barrier composition to the oxidizing agent is about 1:9 to about 1:1.

14. A treated oxidizing agent according to claim 1, wherein the weight ratio of the chemical barrier composition to the oxidizing agent is about 1:5 to about 1:2.

15. A treated oxidizing agent according to claim 1, wherein the oxidizing agent comprises a halogen containing oxidizing agent comprising at least one of potassium dichloroisocyanurate, sodium dichloroisocyanurate, chlorinated trisodium phosphate, calcium hypochlorite, lithium hypochlorite, [(monotrichloro)-tetra-(monopotassium dichloro)]-pentaisocyanurate, trichloromelamine, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethylhydantoin, 1-chloro-3-bromo-5-ethyl-5-methyl hydantoin, dichlorohydantoin, 1,3-dichloro-5-ethyl-5-methyl hydantoin, paratoluene sulfondichloro-amide, N-chlorammeline, N-chloro succinimide, N,N'-dichloroazodicarbonamide, monotrichloro-tetra(monopotassium dichloro-s-triazine trione), trichloro-s-triazine trione salts or hydrates thereof, and mixtures thereof.

16. A coated oxidizing agent according to claim 1, wherein the oxidizing agent comprises a non-halogenated oxidizing agent.

17. A coated oxidizing agent according to claim 16, wherein the non-halogenated oxidizing agent comprises at least one of sodium permanganate, sodium percarbonate, sodium perborate, sodium persulfate, and urea hydrogen peroxide.

18. A coated oxidizing agent according to claim 1, wherein the coated oxidizing agent exhibits an activity reduction of less than about 40% after aging for two weeks at 40° C. in a solid detergent composition.

19. A coated oxidizing agent according to claim 1, wherein the coated oxidizing agent exhibits an activity reduction of less than about 20% after aging for two weeks at 40° C. in a solid detergent composition.

20. A solid detergent composition comprising:

(a) at least about 0.1 wt. % of a treated oxidizing agent, wherein the treated oxidizing agent comprises:

an oxidizing agent that is solid at room temperature and atmospheric pressure; and (ii) a chemical barrier composition provided on the oxidizing agent, the chemical barrier composition comprising a hydrocarbon component having about 10 and about 85 carbon atoms, and wherein the chemical barrier composition is provided as a liquid at 25° C., and does not register a needle penetration value according to ASTM D 1321-97; and (b) at least about 0.1 wt. % of at least one of a surfactant and an alkalinity source.

21. A solid detergent composition according to claim 20, wherein the hydrocarbon component comprises at least one of a normal paraffin hydrocarbon, an isoparaffin hydrocarbon, mineral oil, and petrolatum.

22. A solid detergent composition according to claim 20, wherein the treated oxidizing agent comprises a result of mixing about 50 wt. % to about 90 wt. % of the oxidizing agent and about 10 wt. % and about 50 wt. % of the chemical barrier composition.

23. A solid detergent composition according to claim 20, wherein the chemical barrier composition has an evaporation rate of less than 50% of n-butyl acetate.

24. A solid detergent composition according to claim 20, wherein the chemical barrier composition further comprises a durability additive comprising at least one of paraffin wax, microcrystalline wax, and clay.

25. A solid detergent composition according to claim 20, wherein the weight ratio of the chemical barrier composition to the oxidizing agent is about 1:9 to about 1:1.

26. A solid detergent composition according to claim 20, wherein the weight ratio of the chemical barrier composition to the oxidizing agent is about 1:5 to about 1:2.

27. A solid detergent composition according to claim 20, wherein the oxidizing agent comprises a halogen containing oxidizing agent comprising at least one of potassium dichloroisocyanurate, sodium dichloroisocyanurate, chlorinated trisodium phosphate, calcium hypochlorite, lithium hypochlorite, [(monotrichloro)-tetra-(monopotassium dichloro)]-pentaisocyanurate, trichloromelamine, N-chlorosuccinimide, N,N'-dichloroazodicarbonamide, N-chloro-acetyl-urea, N,N'-dichlorobiuret, chlorinated dicyandiamide, trichlorocyanuric acid, dichloroglycoluril, 1,3-dichloro-5,5-dimethylhydantoin, 1-chloro-3-bromo-5-ethyl-5-methyl hydantoin, dichlorohydantoin, 1,3-dichloro-5-ethyl-5-methyl hydantoin, paratoluene sulfondichloro-amide, N-chlorammeline, N-chlorosuccinimide, N,N'-dichloroazodicarbonamide, monotrichloro-tetra (monopotassium dichloro-s-triazine trione), trichloro-s-triazine trione salts or hydrates thereof, and mixtures thereof.

28. A solid detergent composition according to claim 20, wherein the oxidizing agent comprises a non-halogenated oxidizing agent.

29. A solid detergent composition according to claim 28, wherein the non-halogenated oxidizing agent comprises at least one of sodium permanganate, sodium percarbonate, sodium perborate, sodium persulfate, and urea hydrogen peroxide.

30. A solid detergent composition according to claim 20, wherein the coated oxidizing agent exhibits an activity reduction of less than about 40% after aging for two weeks at 40° C. in the solid detergent composition.

31. A solid detergent composition according to claim 20, wherein the detergent composition comprises about 0.1 wt. % to about 30 wt. % of the treated oxidizing agent.

32. A solid detergent composition according to claim 20, wherein the composition comprises about 1 wt. % to about 80 wt. % of an alkalinity source.

33. A solid detergent composition according to claim 20, wherein the composition comprises about 0.1 wt. % to about 70 wt. % of a chelating/sequestering agent.

34. A solid detergent composition according to claim 20, wherein the composition comprises about 0.1 wt. % to about 20 wt. % of the surfactant.

35. A solid detergent composition according to claim 20, wherein the composition comprises about 0.1 wt. % to about 5 wt. % of a defoaming agent.

36. A solid detergent composition according to claim 20, wherein the composition comprises about 0.5 wt. % to about 10 wt. % of an anti-redeposition agent.

37. A solid detergent composition according to claim 20, wherein the composition comprises about 0.5 wt. % to about 40 wt. % water.

* * * * *